US010208949B2

(12) United States Patent
Eastwood et al.

(10) Patent No.: US 10,208,949 B2
(45) Date of Patent: Feb. 19, 2019

(54) SYSTEM AND APPARATUS FOR COMBUSTION SWIRLER ANTI-ROTATION

(71) Applicant: United Technologies Corporation, Hartford, CT (US)

(72) Inventors: Jonathan J. Eastwood, Vernon, CT (US); Jonathan M. Jause, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 330 days.

(21) Appl. No.: 15/096,624

(22) Filed: Apr. 12, 2016

(65) Prior Publication Data

US 2016/0223193 A1 Aug. 4, 2016

Related U.S. Application Data

(63) Continuation of application No. PCT/US2014/060257, filed on Oct. 13, 2014.

(60) Provisional application No. 61/907,033, filed on Nov. 21, 2013, provisional application No. 61/895,561, filed on Oct. 25, 2013.

(51) Int. Cl.

| | |
|---|---|
| ***F23R 3/60*** | (2006.01) |
| ***F23D 11/38*** | (2006.01) |
| ***F23R 3/14*** | (2006.01) |
| ***F23R 3/28*** | (2006.01) |

(52) U.S. Cl.

CPC ..... *F23D 11/383* (2013.01); *F23R 3/14* (2013.01); *F23R 3/28* (2013.01)

(58) Field of Classification Search

CPC .. F23D 11/383; F23R 3/14; F23R 3/28; F23R 3/60

See application file for complete search history.

(56) References Cited

U.S. PATENT DOCUMENTS

| | | | | |
|---|---|---|---|---|
| 5,237,820 | A * | 8/1993 | Kastl | F23D 23/00 60/747 |
| 5,916,142 | A | 6/1999 | Snyder et al. | |
| 6,976,363 | B2 | 12/2005 | McMasters et al. | |
| 7,134,286 | B2 | 11/2006 | Markarian et al. | |
| 7,415,826 | B2 | 8/2008 | McMasters et al. | |
| 7,478,534 | B2 | 1/2009 | Guezengar et al. | |

(Continued)

FOREIGN PATENT DOCUMENTS

| | | |
|---|---|---|
| EP | 2278226 | 1/2011 |

OTHER PUBLICATIONS

International Search Report and Written Opinion dated Jan. 26, 2015 in Application No. PCT/US2014/060257.

(Continued)

*Primary Examiner* — Steven Sutherland
(74) *Attorney, Agent, or Firm* — Snell & Wilmer L.L.P.

(57) ABSTRACT

A swirler comprising an anti-rotation feature is provided. The swirler may be installed on a combustor within a gas turbine engine. The swirler may comprise a generally cylindrical profile. In this regard, the swirler may be configured to provide a generally uniform profile within the combustor. The swirler may comprise a floating collar with an anti-rotation feature. The swirler may also include a collar end plate that defines a slot that at least partially encloses the anti-rotation feature and minimizes rotational movement of the floating collar.

13 Claims, 6 Drawing Sheets

(56) References Cited

U.S. PATENT DOCUMENTS

| | | | | |
|---|---|---|---|---|
| 7,543,383 | B2 | 6/2009 | Patel et al. | |
| 2007/0033950 | A1 | 2/2007 | Bernier | |
| 2009/0255259 | A1* | 10/2009 | Kastrup | B23P 6/007 60/737 |
| 2011/0005231 | A1* | 1/2011 | Low | F23R 3/14 60/740 |
| 2013/0283803 | A1* | 10/2013 | Bunel | F23R 3/14 60/737 |

OTHER PUBLICATIONS

International Preliminary Report on Patentability dated Apr. 26, 2016 in Application No. PCT/US2014/060257.
EP Search Report dated Jun. 8, 2017 in EP Application No. 14855449.6.

* cited by examiner

SYSTEM AND APPARATUS FOR COMBUSTION SWIRLER ANTI-ROTATION

CROSS-REFERENCE TO RELATED APPLICATIONS

This application is a continuation of, claims priority to and the benefit of, PCT/US2014/060257 filed on Oct. 13, 2014 and entitled "SYSTEM AND APPARATUS FOR COMBUSTION SWIRLER ANTI-ROTATION," which claims priority from U.S. Provisional Application Nos. 61/907,033 filed on Nov. 21, 2013 and entitled "SYSTEM AND APPARATUS FOR COMBUSTION SWIRLER ANTI-ROTATION" and 61/895,561 filed Oct. 25, 2013 and entitled "SYSTEM AND APPARATUS FOR COMBUSTION SWIRLER ANTI-ROTATION." All of the aforementioned applications are incorporated herein by reference in their entirety.

FIELD

The present disclosure relates to systems and apparatuses for a combustor swirler, and more specifically, to systems and apparatuses for minimizing rotation of swirler components.

BACKGROUND

Gas turbine engine combustors may employ swirlers to improve fuel atomization. These swirlers may be mounted on and/or coupled to fuel injectors within the gas turbine. They may include installation features that minimize the ability of a mechanic and/or assembler to improperly install the swirler. Moreover, the swirlers may include stabilization features that minimize movement of the swirlers and/or wear between a swirler and a fuel injector.

SUMMARY

In various embodiments, a combustor may comprise a fuel injector, a combustion chamber, and a swirler. The combustion chamber may be configured to receive fuel from the fuel injector. The swirler may comprise a floating collar and a collar end plate. The floating collar may comprise an anti-rotation feature. The collar end plate may define a notch. The swirler may be installable on the fuel injector and configured to deliver atomized fuel to the combustion chamber.

In various embodiments, a gas turbine engine may comprise a compressor, a turbine, a combustor. The turbine may be configured to drive the compressor. The combustor may be configured to drive the turbine. The combustor may comprise an injector, and a swirler. The combustor may define a combustion chamber. The combustion chamber may be configured to receive fuel from the injector. The swirler may comprise an anti-rotation feature retained within a slot defined in the swirler. The swirler may be installed on the injector and configured to conduct and atomize fuel to the combustion chamber.

In various embodiments, a swirler may comprise a housing, a floating collar, and a collar end plate. The housing may define a volume. The floating collar may be contained within the volume defined by the housing. The floating collar may comprise an anti-rotation feature. The housing may also comprise a collar end plate. The collar end plate may be operatively coupled to the housing and configured to contain the floating collar within the volume. The collar end plate may define a channel that is configured to receive the anti-rotation feature and limit rotational movement of the floating collar. The swirler may have a generally cylindrical profile.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Different cross-hatching and/or surface shading may be used throughout the figures to denote different parts but not necessarily to denote the same or different materials.

Figure 1:
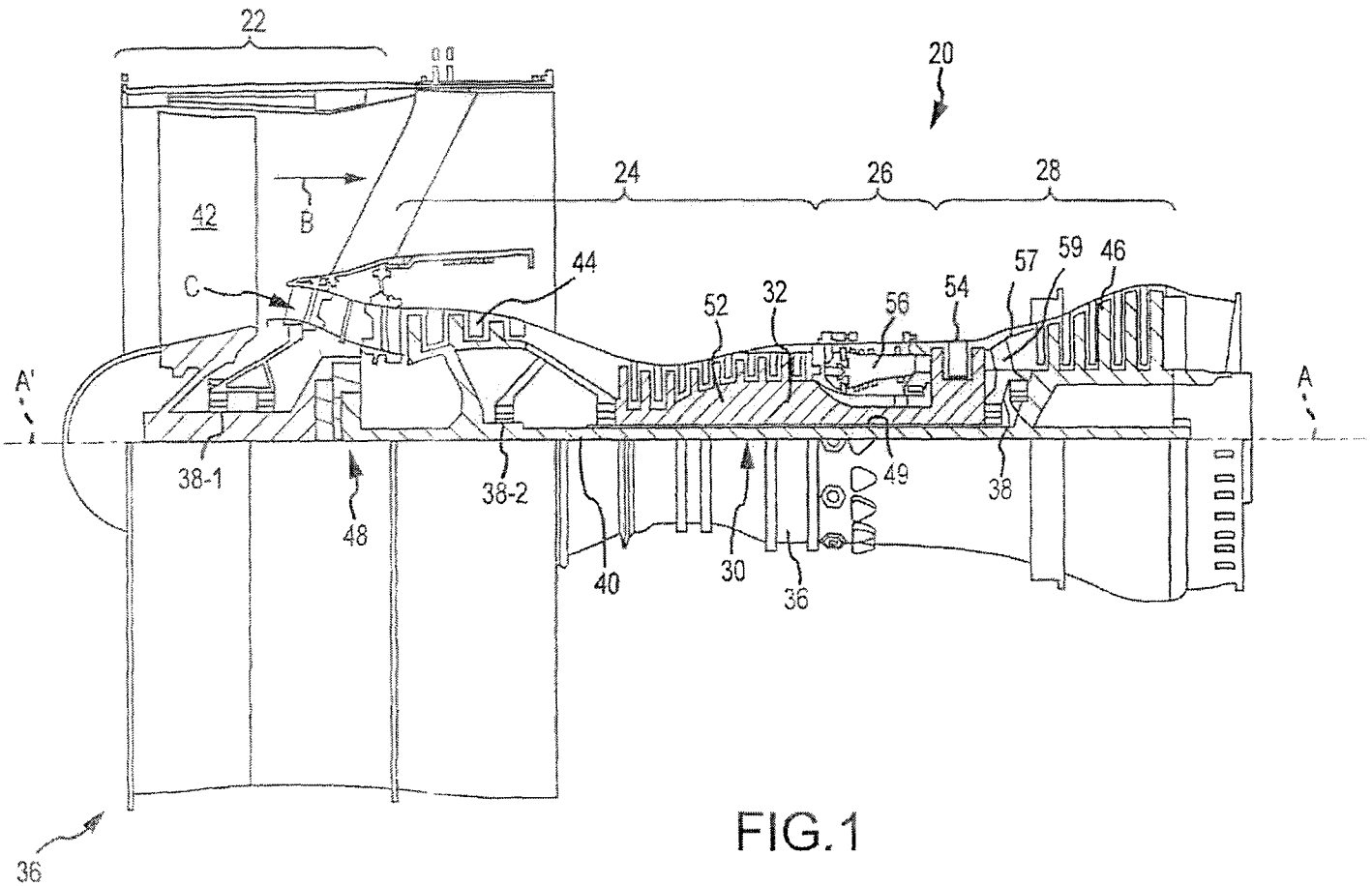
FIG. 1 is a cross-sectional view of a gas turbine engine, in accordance with various embodiments

In various embodiments, and with reference to FIG. 1, a gas turbine engine 20 is provided. Gas turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive air along a bypass flow-path B while compressor section 24 can drive air along a core flow-path C for compression and communication into combustor section 26 then expansion through turbine section 28. Although depicted as a turbofan gas turbine engine herein, it should be understood that the concepts described herein are not limited to use with turbofans as the teachings may be applied to other types of turbine engines including three-spool architectures.

Gas turbine engine 20 may generally comprise a low speed spool 30 and a high speed spool 32 mounted for rotation about an engine central longitudinal axis A-A' relative to an engine static structure 36 via several bearing systems 38, 38-1, and 38-2. It should be understood that various bearing systems at various locations may alternatively or additionally be provided, including for example, bearing system 38, bearing system 38-1, and bearing system 38-2.

Low speed spool 30 may generally comprise an inner shaft 40 that interconnects a fan 42, a low pressure (or first) compressor section 44 and a low pressure (or first) turbine section 46. Inner shaft 40 may be connected to fan 42 through a geared architecture 48 that can drive fan 42 at a lower speed than low speed spool 30. High speed spool 32 may comprise an outer shaft 49 that interconnects a high pressure (or second) compressor section 52 and high pressure (or second) turbine section 54. A combustor 56 may be located between high pressure compressor 52 and high pressure turbine 54. A mid-turbine frame 57 of engine static structure 36 may be located generally between high pressure turbine 54 and low pressure turbine 46. Mid-turbine frame 57 may support one or more bearing systems 38 in turbine section 28. Inner shaft 40 and outer shaft 49 may be concentric and rotate via bearing systems 38 about the engine central longitudinal axis A-A', which is collinear with their longitudinal axes. As used herein, a "high pressure" compressor or turbine experiences a higher pressure and temperature than a corresponding "low pressure" compressor or turbine.

The core airflow C may be compressed by low pressure compressor 44 then high pressure compressor 52, mixed and burned with fuel in combustor 56, then expanded over high pressure turbine 54 and low pressure turbine 46. Mid-turbine frame 57 includes airfoils 59 which are in the core airflow path. Turbines 46, 54 rotationally drive the respective low speed spool 30 and high speed spool 32 in response to the expansion.

Gas turbine engine 20 may be, for example, a high-bypass geared aircraft engine. In various embodiments, the bypass ratio of gas turbine engine 20 may be greater than about six (6). In various other embodiments, the bypass ratio of gas turbine engine 20 may be greater than ten (10). In various embodiments, geared architecture 48 may be an epicyclic gear train, such as a star gear system (sun gear in meshing engagement with a plurality of star gears supported by a carrier and in meshing engagement with a ring gear) or other gear system. Gear architecture 48 may have a gear reduction ratio of greater than about 2.3 and low pressure turbine 46 may have a pressure ratio that is greater than about 5. In various embodiments, the diameter of fan 42 may be significantly larger than that of the low pressure compressor 44, and the low pressure turbine 46 may have a pressure ratio that is greater than about 5:1. Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other gas turbine engines including direct drive turbofans.

Figure 2:
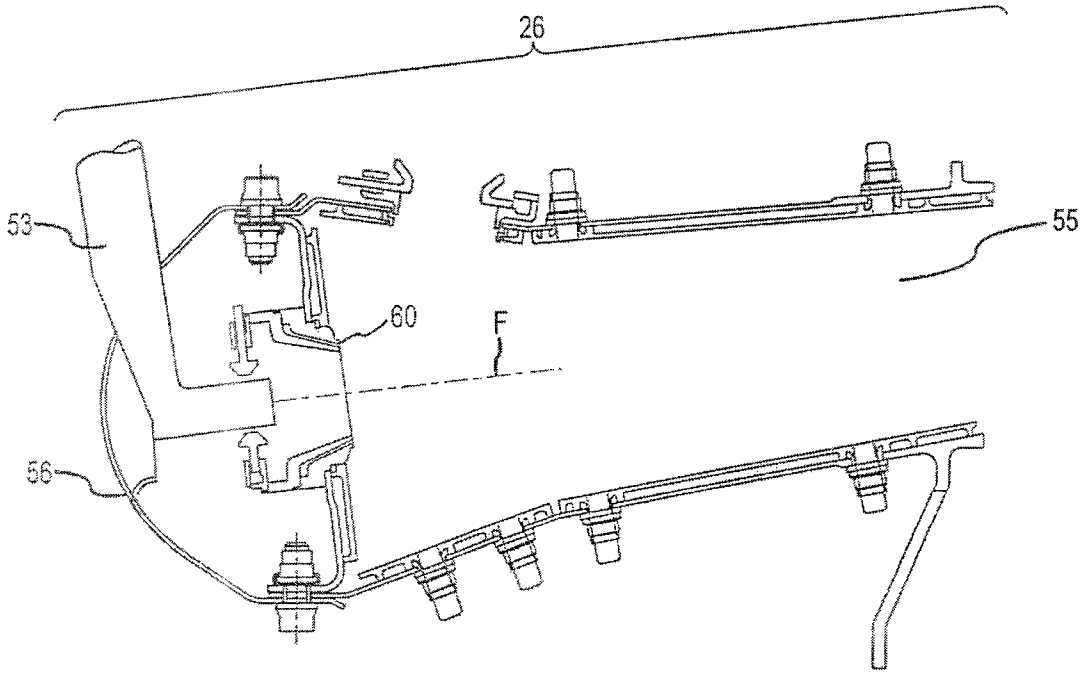
FIG. 2 is a cross-sectional view of a portion of a gas turbine engine combustor, in accordance with various embodiments.

In various embodiments and with reference to FIG. 2, combustor section 26 and/or combustor 56 may comprise a fuel injector 53, and may define a combustion chamber 55 (e.g., a combustion volume 55). Combustor 56 may also comprise a swirler 60. Swirler 60 may attach and/or operatively couple to injector 53. Fuel may be supplied from a fuel source, an aircraft and/or gas turbine engine 20 to injector 53 and through swirler 60 into combustion chamber 55 of combustor 56. Swirler 60 may be configured to atomize fuel to create an air fuel mixture for efficient fuel combustion within combustion chamber 55. In this regard, fuel passed through swirler 60 may be vaporized and/or dispersed into small droplets to promote efficient combustion and/or flame propagation with combustion chamber 55.

In various embodiments and with reference to FIGS. 3A-3D, swirler 60 may comprise a swirler body 62, a floating collar housing 66, a floating collar 68, and a collar end plate 70. Swirler body 62 may be coupled to and/or attached to floating collar-housing 66. Swirler body 62 and floating collar housing 66 may be an assembly or a single piece. Swirler body 62 and floating collar housing 66 may define a volume. Floating collar 68 may be installable within the volume defined by swirler body 62 and floating collar-housing 66. Moreover, floating collar 68 may be retained within the volume (e.g., the volume defined by swirler body 62 and floating collar housing 66) by collar end plate 70. In this regard, collar end plate 70 may be coupled to and/or attached to (e.g. welded or brazed) floating collar-housing 66.

In various embodiments, floating collar 68 may be configured to couple to and/or be operatively coupled to a nozzle and/or portion of injector 53, as shown in FIG. 2. In this regard floating collar 68 may be configured with a passage and/or aperture that is receivable over a nozzle and/or portion of injector 53.

Figure 3A:
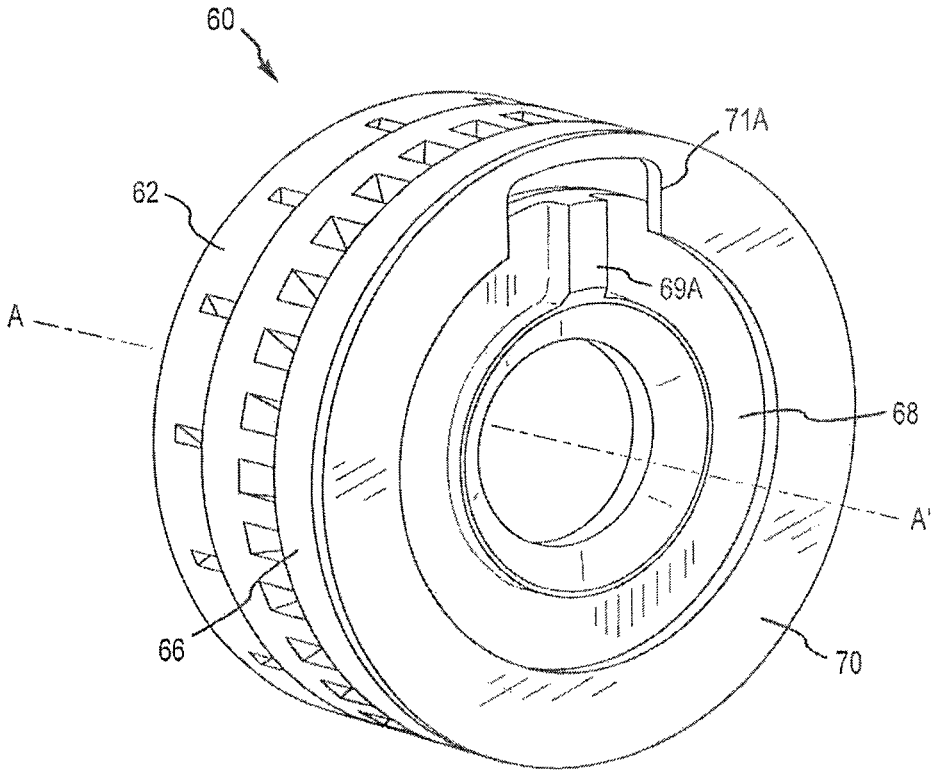
FIG. 3A illustrates a perspective view of a first swirler assembly, in accordance with various embodiments.
Figure 3B:
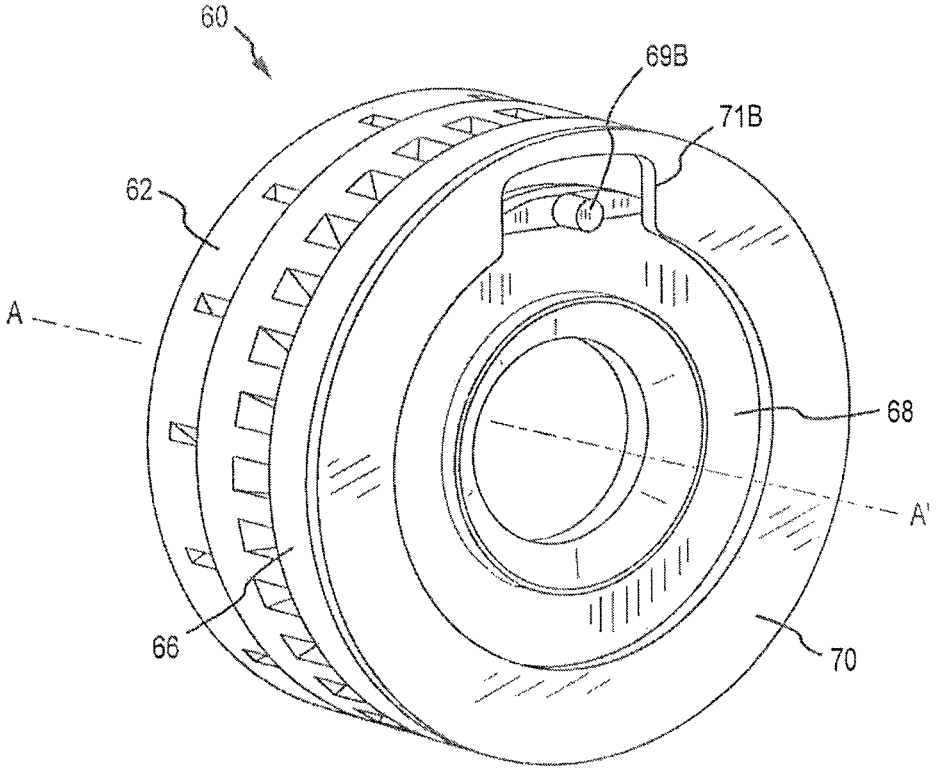
FIG. 3B illustrates a perspective view of a second swirler assembly, in accordance with various embodiments.
Figure 3C:
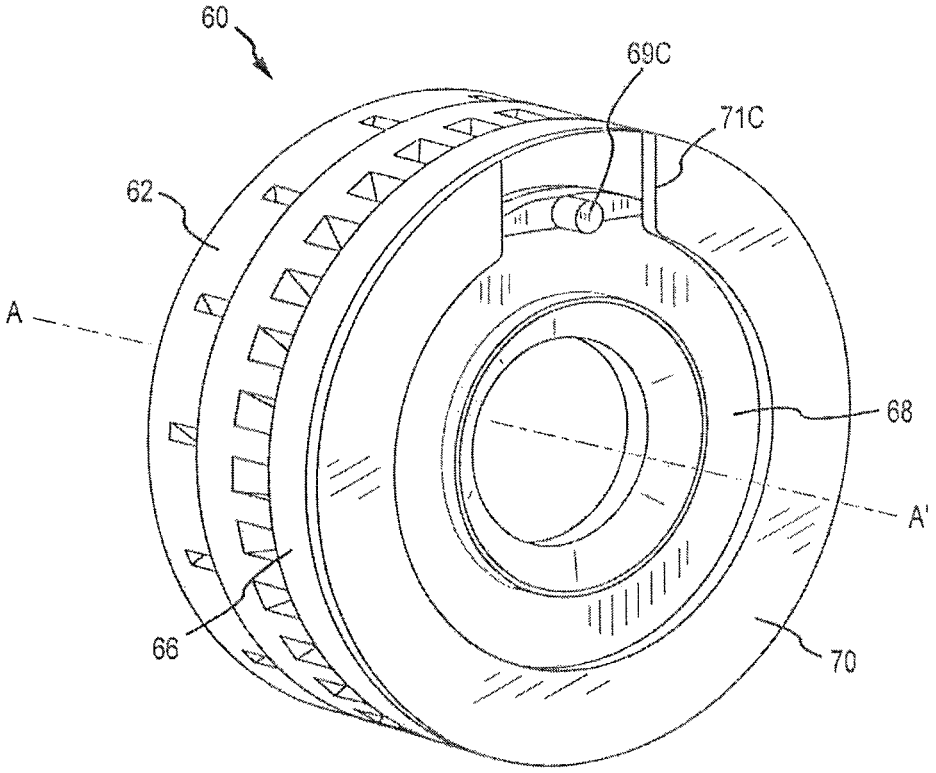
FIG. 3C illustrates a perspective view of a third swirler assembly, in accordance with various embodiments.
Figure 3D:
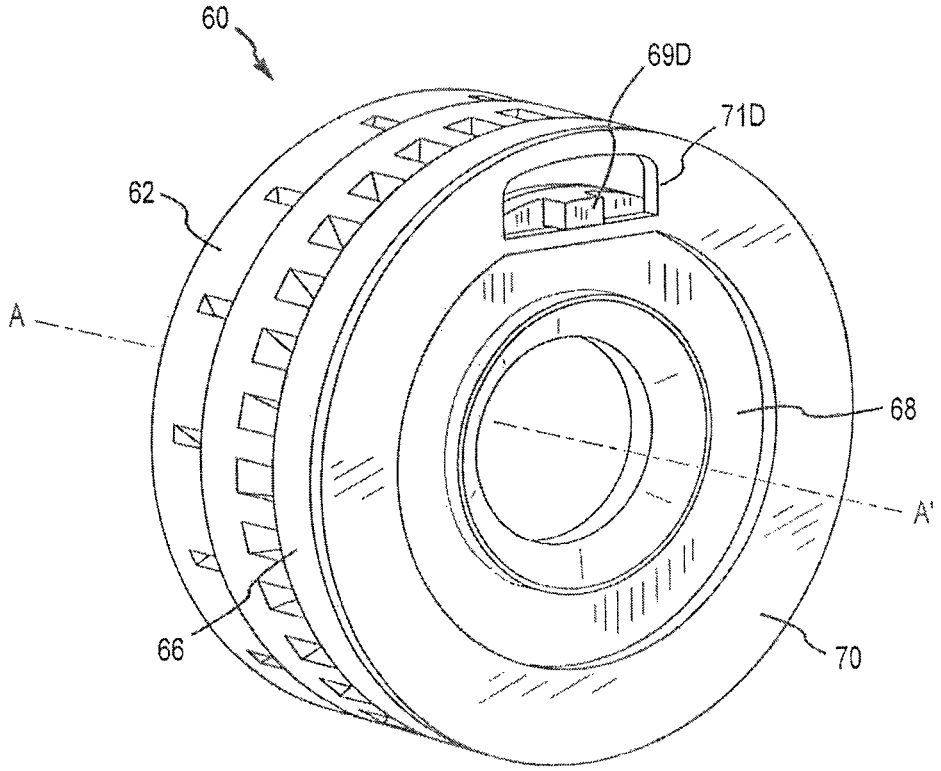
FIG. 3D illustrates a perspective view of a fourth swirler assembly, in accordance with various embodiments.

In various embodiments, swirler 60 may further comprise an anti-rotation feature 69 (anti-rotation feature 69 is shown as 69A in FIG. 3A, 69B in FIG. 3B, 69C in FIG. 3C, and 69D in FIG. 3D). Anti-rotation feature 69 may be a protrusion extending from and/or a raised portion of floating collar 68. In this regard, anti-rotation feature 69 may be formed in and/or operatively coupled to floating collar 68. Collar end plate 70 may comprise a slot and/or stop 71 (slot and/or stop 71 is shown as 71A in FIG. 3A, 71B in FIG. 3B, 71C in FIG. 3C, and 71D in FIG. 3D). In this regard, anti-rotation feature 69 may be contained or installed within stop 71.

In various embodiments, floating collar 68 may float and/or freely move within the volume defined by swirler body 62 and floating collar-housing 66. In this regard, floating collar 68 may be contained within that volume by collar end plate 70, but would be free to otherwise rotate. To minimize this ability to rotate, floating collar 68 may comprise anti-rotation feature 69. Anti-rotation feature 69 may be contained within stop and/or notch 71. In this regard, floating collar 68 may be partially rotatable and/or adjustable. This adjustability may make installation injector into swirler 60 more efficient, allowing floating collar 68 to be adjusted rotationally to couple to a nozzle or portion of the injector in the combustor, as discussed herein.

In various embodiments and with reference to FIGS. 3A-3D, stop 71 may be a notch (e.g., a passage portion within collar end plate 70 having at least one open side), as shown in FIGS. 3A and 3B, a gap (e.g., an open area defined between a first side and a second side of collar end plate 70), as shown in FIG. 3C, a channel (e.g. an opening within collar end plate 70 having four (4) sides), as shown in FIG. 3D, and/or any other suitable shape and/or opening in collar end plate 70 that is configured to contain anti-rotation feature 69. In this regard, notch 70 may be configured to partially and/or fully surround anti-rotation feature 69. Moreover, anti-rotation feature 69 may be any suitable shape and/or size that is capable of being installed within stop 71 (e.g., a notch and/or a channel). For example, anti-rotation may have a square and/or rectangular profile (e.g., anti-rotation feature 69A as shown in FIG. 3A and/or anti-rotation feature 69D as shown in FIG. 3D), a round, elliptical and/or circular profile (e.g., anti-rotation feature 69B as shown in FIG. 3B and/or anti-rotation feature 69C as shown in FIG. 3C), and/or any other suitable shape and/or profile.

In various embodiments, swirler 60 may be configured to provide uniform flow distribution around swirler 60. In this regard, anti-rotation features 69 and notch 71 are defined and/or installed within the outer profile of swirler 60. Unlike anti-rotation features in typical swirlers, anti-rotation feature 69 and/or notch 71 may not protrude out of the profile of swirler 60 (e.g., the outer diameter of collar end plate 70). As such, anti-rotation feature 69 and/or notch 70 do not disrupt airflow around swirler 60.

In various embodiments, floating collar 68 may be configured to float and/or may be free to move with respect to axis A-A'. However anti-rotation feature 69 and/or notch 71 may constrain and/or limit or minimize any rotational movement. In this regard, the lateral and/or longitudinal movement of floating collar 68 may be beneficial for installing swirler 60 on the tip or nozzle of an injector. Moreover, limiting and/or constraining the rotation of floating collar 68 may prevent wear on the nozzle or tip of the injector.

In various embodiments, swirler 60 may be installed in any suitable combustor. For example, swirler 60 may be used with a can-style combustor or an axial flow combustor (e.g., as shown in FIGS. 1 and 2).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A combustor, comprising:
- a fuel injector;
- a combustion chamber configured to receive fuel from the fuel injector; and
- a swirler comprising a floating collar comprising an anti-rotation feature and a collar end plate defining a notch;
- wherein the swirler is installable on the fuel injector;
- wherein the swirler is configured to deliver atomized fuel to the combustion chamber;
- wherein the notch is defined as a channel having four sides within the collar end plate;

and
- wherein the swirler has a cylindrical profile and the anti-rotation feature does not protrude beyond the cylindrical profile of the swirler.

2. The combustor of claim 1, wherein the combustor is an axial flow combustor.

3. The combustor of claim 1, wherein the combustor defines the combustion chamber.

4. A gas turbine engine, comprising:
- a compressor,
- a turbine configured to drive the compressor; and
- a combustor configured to drive the turbine, the combustor comprising:
  - an injector;
  - a combustion chamber defined by the combustor and configured to receive fuel from the injector; and
  - a swirler comprising a floating collar comprising an anti-rotation feature and a collar end plate defining a slot, the anti-rotation feature being retained within the slot;
  - wherein the swirler is installed on the injector;
  - wherein the swirler is configured to conduct and atomize fuel to the combustion chamber;
  - wherein the slot is defined as a channel having four sides; and
  - wherein the swirler has a cylindrical profile and the anti-rotation feature does not protrude beyond the cylindrical profile of the swirler.

5. The gas turbine engine of claim 4, wherein the combustor is an axial flow combustor.

6. The gas turbine engine of claim 4, wherein the swirler comprises a uniform outer profile.

7. The gas turbine engine of claim 4, wherein the collar end plate minimizes rotation of the floating collar within the swirler.

8. The gas turbine engine of claim 7, wherein the floating collar is configured to couple to a portion of the injector.

9. The gas turbine engine of claim 7, wherein the collar end plate is configured to allow radial motion.

10. A swirler, comprising:

a housing defining a volume;

a floating collar contained within the volume defined by the housing, the floating collar comprising an anti-rotation feature; and a collar end plate operatively coupled to the housing and configured to contain the floating collar within the volume;

wherein the collar end plate defines a channel that is configured to receive the anti-rotation feature and to limit rotational movement of the floating collar;

wherein the swirler has a cylindrical profile;

wherein the channel is defined as a slot having four sides;

wherein the anti-rotation feature does not protrude beyond the cylindrical profile of the swirler.

11. The swirler of claim 10, wherein the swirler is installable on an injector of a gas turbine engine.

12. The swirler of claim 10, wherein a first side, a second side, and, a third side define the channel formed in the collar end plate.

13. The swirler of claim 12, wherein a fourth side defines the channel in the collar end plate.

* * * * *